United States Patent [19]

Itakura

[11] Patent Number: 4,759,316

[45] Date of Patent: Jul. 26, 1988

[54] COOLING SYSTEM FOR INTERNAL COMBUSTION ENGINES

[75] Inventor: Masato Itakura, Toyota, Japan

[73] Assignee: Aisin Seiki Kabushiki Kaisha, Kariya, Japan

[21] Appl. No.: 72,653

[22] Filed: Jul. 7, 1987

[30] Foreign Application Priority Data

Jul. 7, 1986 [JP] Japan ..... 61-158074

[51] Int. Cl.[4] ..... F01P 7/16

[52] U.S. Cl. ..... 123/41.08; 123/41.1; 123/41.29; 123/41.44; 236/34.5

[58] Field of Search ..... 123/41.08, 41.09, 41.1, 123/41.44, 41.29, 41.82 R, 41.82 A, 41.72; 236/34.5

[56] References Cited

U.S. PATENT DOCUMENTS

| | | | |
|---|---|---|---|
| 4,319,547 | 3/1982 | Bierling | 123/41.29 |
| 4,369,738 | 1/1983 | Hirayama | 123/41.29 X |
| 4,370,950 | 2/1983 | Furukubo | 123/41.08 |
| 4,381,736 | 5/1983 | Hirayama | 123/41.29 X |
| 4,413,596 | 11/1983 | Hirayama | 123/41.29 X |
| 4,621,594 | 11/1986 | Kubis | 123/41.29 X |

FOREIGN PATENT DOCUMENTS

| | | | |
|---|---|---|---|
| 213918 | 3/1984 | Japan | 123/41.29 |

*Primary Examiner*—Tony M. Argenbright

*Attorney, Agent, or Firm*—Oblon, Fisher, Spivak, McClelland & Maier

[57] ABSTRACT

A cooling system for an internal combustion engine comprising independent head-side and block-side water jackets and a shared radiator and cooling fan. Further included are a first cooling water conduit connecting the outlet of the head-side jacket and the inlet of the radiator, a mixing valve having two water inlets and one water outlet, a second cooling water conduit connecting one water inlet and the outlet of the radiator, a third conduit connecting the water outlet of the block-side jacket and the other water inlet, a water pump connected between the outlet of the mixing valve and the block-side jacket, a fourth conduit branched from the second conduit and connected with the inlet of the head-side jacket, an auxiliary water pump disposed in the fourth conduit pumping water to said head-side jacket, a fifth conduit branched from the third conduit and connected with the first conduit, a one-way valve disposed in the fifth conduit allowing water to flow only from the third conduit to the first conduit, a one-way valve disposed in the second conduit between the branch point of the fourth conduit and the mixing valve allowing water to flow only from the branch point to the mixing valve, and a control unit controlling the mixing ratio of the mixing valve, the auxiliary water pump and the cooling fan.

4 Claims, 1 Drawing Sheet

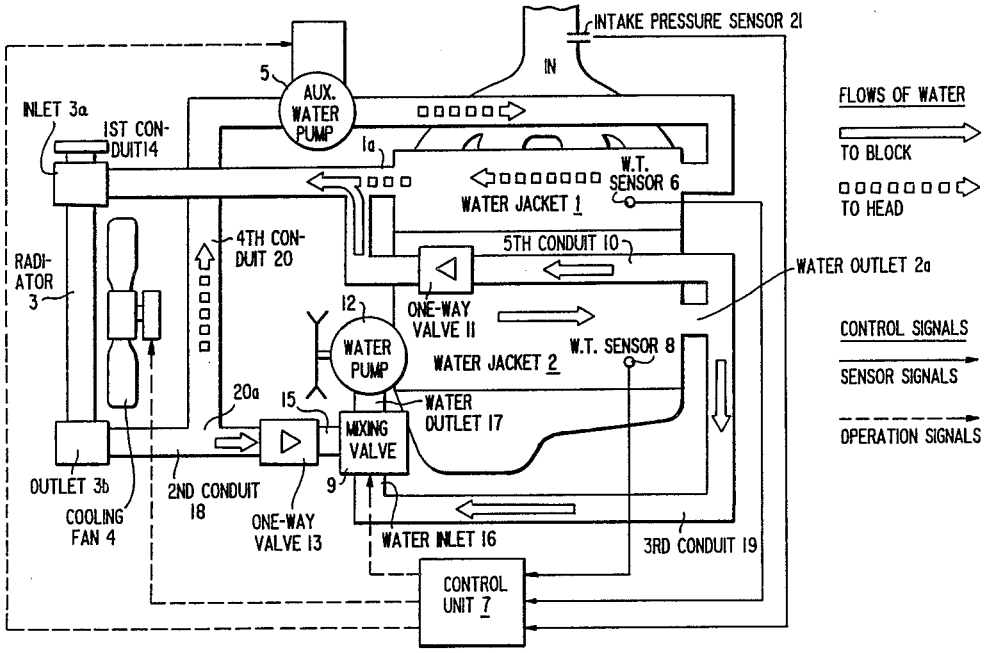

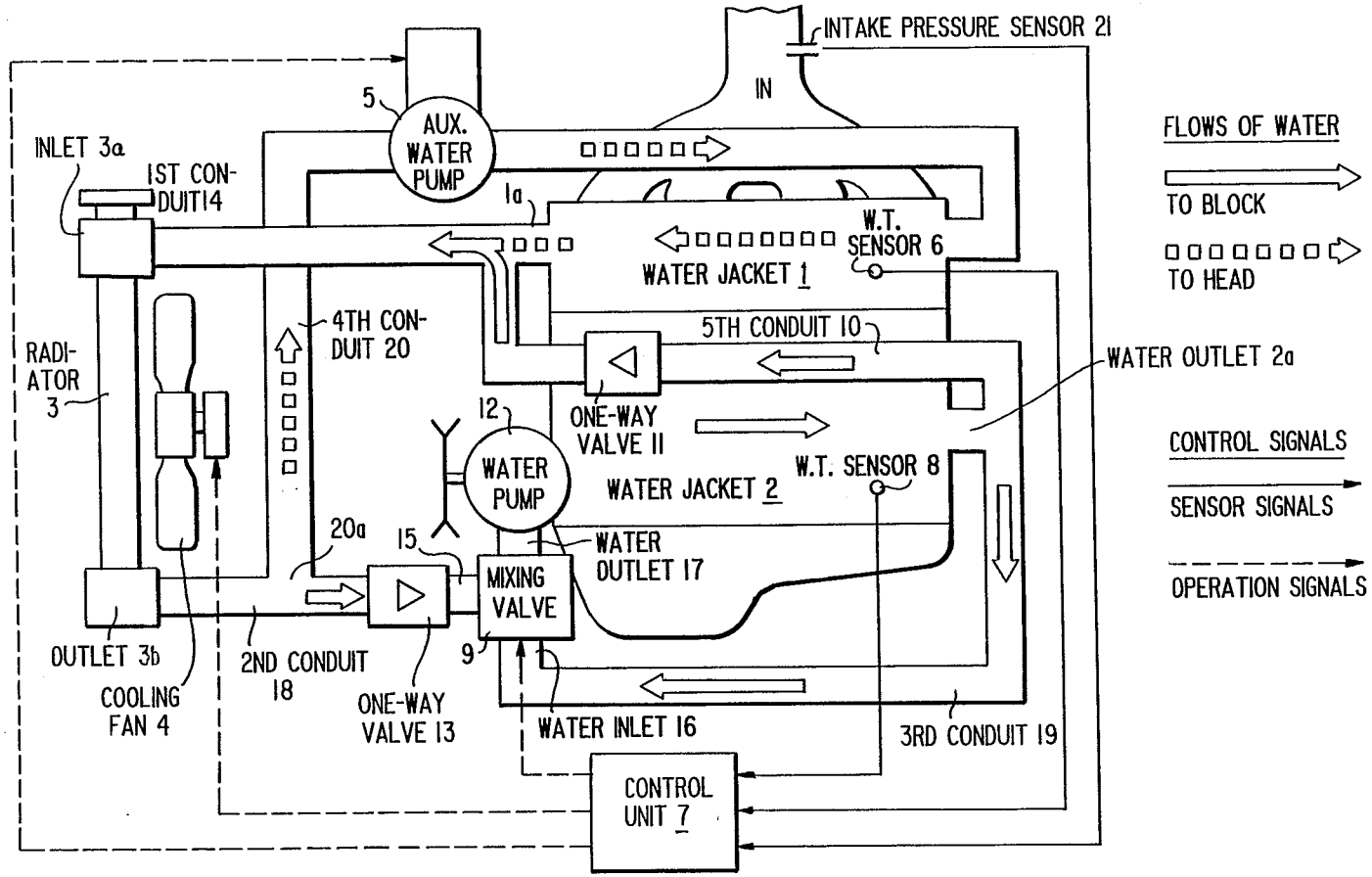
FLOWS OF WATER
TO BLOCK
TO HEAD
CONTROL SIGNALS
SENSOR SIGNALS
OPERATION SIGNALS
WATER OUTLET 2a
INTAKE PRESSURE SENSOR 21
IN
W.T. SENSOR 6
W.T. SENSOR 8
3RD CONDUIT 19
WATER JACKET 1
5TH CONDUIT 10
WATER JACKET 2
ONE-WAY VALVE 11
WATER OUTLET 17
WATER INLET 16
CONTROL UNIT 7
AUX. WATER PUMP
1a
WATER PUMP
12
MIXING VALVE
9
15
ONE-WAY VALVE 13
5
4TH CONDUIT 20
20a
2ND CONDUIT 18
1ST CONDUIT 14
COOLING FAN 4
INLET 3a
RADIATOR 3
OUTLET 3b

COOLING SYSTEM FOR INTERNAL COMBUSTION ENGINES

BACKGROUND OF THE INVENTION

1. Field of the Invention

The present invention relates to a cooling system for an automotive internal combustion engine, which includes a cylinder head-water jacket and a cylinder block water jacket made independent of each other, and a head-side cooling system and a block-side cooling system connected with a common radiator.

2. Description of the Prior Art

In the prior art, there has been proposed a cooling system for an internal combustion engine, in which the water jackets of a cylinder head and a cylinder block are made independent of each other to provide head-side and block-side cooling lines connected to a common radiator and a common water pump, as is disclosed in Japanese Patent Laid-Open No. 213918/1984. In this cooling system, a water pump has its discharge pipe branched to head-side and block-side conduits connected to the respective inlets of the head-side and block-side water jackets. Moreover, the head-side and block-side passages are variably throttled to control the water flow rates and accordingly the water temperatures.

In the aforementioned cooling system of the prior art, the discharge pipe of the water pump is shared between the head and block sides so that the water jackets of the two sides have substantially the same inlet water temperature. The smaller difference between the inlet and outlet temperatures of the jackets is the more advantageous for the anti-knocking performance of the engine. Since the aforementioned system of the prior art has the common inlet water temperature, however, the flow rate has to be throttled at a higher temperature side if the (average) water temperature is differentiated according to the difference in the flow rate, thus raising a problem that the difference between the inlet and outlet temperatures of the jackets is enlarged.

SUMMARY OF THE INVENTION

The present invention has been proposed to solve the aforementioned problem of the prior art.

According to the present invention, this problem is solved by a cooling system for an internal combustion engine, comprising: a head-side water jacket and a block-side water jacket made independent of each other; and a radiator and a cooling fan shared between said two water jackets, wherein the improvement comprises: a first cooling water conduit for connecting the outlet of said head-side water jacket and the inlet of said radiator; a mixing valve having two water inlets and one water outlet; a second cooling water conduit for connecting one of the water inlets of said mixing valve and the outlet of said radiator; a third conduit for connecting the water outlet of said blockside water jacket and the remaining one of the water inlets of said mixing valve; a water pump connected between the water outlet of said mixing valve and said block-side water jacket for pumping water to said block-side water jacket; a fourth conduit branched midway from said second conduit and connected with the water inlet of said head-side water jacket; an auxiliary water pump disposed midway of said fourth conduit for pumping water to said head-side water jacket; a fifth conduit branched midway from said third conduit and connected with said first conduit; a oneway valve disposed midway of said fifth conduit for allowing the water to flow only from said third conduit to said first conduit; a one-way valve dispose midway of said second conduit and between the branch point of said fourth conduit and said mixing valve for allowing the water to flow only from said branch point to said mixing valve; and a control unit for controlling the mixing ratio of said mixing valve, the displacement of said auxiliary water pump and the operation of said cooling fan.

The water temperature of the head-side water jacket is held at a low level by circulating the cold water, which has been fed from the head-side water jacket and cooled down by the cooling fan or the coming wind, by means of an auxiliary water pump. At this time, the control unit compares the water temperature of the head-side water jacket with a set level, when it receives a signal dictating the water temperature, to produce such a series of control signals as to control the displacement of the auxiliary water pump and the r.p.m. of the cooling fan so that the water temperature may approach to that set level. On the other hand, the water temperature control of the block-side water jacket is performed as follows. The control unit compares the water temperature of the block side with a set level, when it receives a signal dictating the water temperature, so that the mixing valve mixes the hot water having flown from the block-side water jacket with the cold water having passed through the radiator at a controlled mixing ratio in accordance with the load upon the engine. Moreover, the fifth conduit has a function to regulate the water flow rates of the two block- and head-side lines. The one-way valve in the fifth conduit prevents the cold water of the head-side water jacket from being sucked into the mixing valve by the pumping action of the block-side water pump, whereas the one-way valve in the second conduit prevents the mixing valve from having its function disordered by the sucking action of the auxiliary water pump.

BRIEF DESCRIPTION OF THE DRAWING

The accompanying drawing presents a block diagram showing a cooling system for an internal combustion engine according to an embodiment of the present invention.

DESCRIPTION OF THE PREFERRED EMBODIMENT

The present invention will be described in the following in connection with one embodiment thereof with reference to the accompanying drawing. Reference numerals 1 and 2 designate a head-side water jacket and a block-side water jacket, respectively, which are made independent of each other in the body of an internal combustion engine. Incidentally, in the two-line cooling system of this kind, the head-side water jacket is usually held at a lower temperature than the blockside water jacket so as to improve the engine performance.

Because the viscosity of the engine oil is reduced by means of holding the block-side water jacket temperature at a high temperature compared to the headside water jacket temperature. As a result, the sliding resistance (friction loss) of the crank journals and the piston and so on is decreased, and the mechanical efficiency of the engine is good. And it is possible to prevent the occurrence of the knocking of the engine by means of holding the head-side water jacket temperature at a low temperature. As a result, the compression ratio of the engine can be determined to be high, and the thermal efficiency of the engine can be improved. Designated at numerals 3 and 4 are a radiator and a cooling fan, respectively, which are shared between the two lines.

Reference numeral 14 designates a first cooling water conduit for connecting the water outlet 1*a* of the head-side water jacket 1 and the inlet 3*a* of the radiator 3. Numeral 9 designates a mixing valve having two water inlets 15 and 16 and one water outlet 17. Numeral 18 designates a second cooling water conduit for connecting the one water inlet 15 of the mixing valve 9 and the outlet 3*b* of the radiator 3. Numeral 29 designates a third conduit for connecting the water outlet 2*a* of the block-side water jacket 2 and the remaining one water inlet 16 of the mixing valve 9. Numeral 12 designates a water pump which is connected between the water outlet 17 of the mixing valve 9 and the block-side water jacket 2 for pumping the water to said water jacket 2. Numeral 20 designates a fourth conduit which is branched midway from the second conduit 18 and connected to the head-side water jacket 1. Numeral 5 designates an auxiliary water pump which is disposed midway of said fourth conduit 20 for pumping the water to the head-side water jacket 1. Numeral 10 designates a fifth conduit which is branched midway from the third conduit 19 and connected to the first conduit 14. Numeral 11 designates a one-way valve which is disposed midway of the fifth conduit 10 for allowing the water to flow only from the third conduit 19 to the first conduit 14. Numeral 13 designates a one-way valve which is disposed midway of the second conduit 18 and between the branch point 20*a* of the fourth conduit 20 and the mixing valve 9 for allowing the water to flow only from the branch point 20*a* to the mixing valve 9. Numeral 7 designates a control unit for controlling the mixing ratio of the mixing valve 9, the displacement of the auxiliary water pump 5 and the operation of the cooling fan 4 in accordance with the intake pressure of the engine, which is detected by an intake pressure sensor 21, and the water temperatures in the aforementioned two jackets 1 and 2, which are detected by water temperature sensors 6 and 8.

The operations of the embodiment thus constructed will be described in the following. The cold water, which has been cooled down in the radiator 3 by the cooling fan 4 or the coming wind, is pumped to the head-side water jacket 1 by the action of the auxiliary water pump 5 so that the water temperature of the headside water jacket 1 is held at a low level. At this time, the control unit compares the water temperature dictated by the signal received from the water temperature sensor 6 with a set level t (e.g., 70 {C) to produce a series of control signals in accordance with the engine load judged by the intake pressure sensor 21, to control the displacement of the auxiliary water pump 5 and the r.p.m. of the cooling fan 4 so that the water temperature may approach to the set level.

On the other hand, the water temperature of the block-side water jacket 2 is controlled as follows. The control unit 7 compares the water temperature dictated by the signal of the water temperature sensor 8 with a set level t2 (e.g., 90 {C) so that the mixing valve 9 may be controlled in accordance with the engine load to mix the hot water having flow out from the block-side water jacket 2 and the cold water having passed through the radiator 3 at a controlled mixing ratio. The fifth conduit has a function to regulate the water flow rates of the two lines. The one-way valve 11 in said conduit 10 prevents the cold water of the head-side water jacket 1 from flowing into the mixing valve 9 by the sucking action of the block-side water pump 12, whereas the other one-way valve 13 prevents the function of the mixing valve 9 from being disordered by the sucking action of the auxiliary water pump 5.

As has been described in detail hereinbefore, with the construction of the present invention, the water temperature of the block-side water jacket can be mixed and controlled while retaining a flow rate sufficient for holding the temperature difference between the inlet and outlet at a small value. Moreover, the water at the outlet side of the radiator can be fed directly to another water pump so that the head-side water jacket may be at a low temperature while holding the inlet and outlet temperature difference at a small value. This makes it possible to reduce the temperature differences between the water inlets and outlets of the head- and block-side water jackets.

What is claimed is:

1. A cooling system for an internal combustion engine, comprising: a head-side water jacket and a block-side water jacket made independent of each other; and a radiator and a cooling fan shared between said two water jackets, wherein the improvement comprises:

a first cooling water conduit for connecting the outlet of said head-side water jacket and the inlet of said radiator;

a mixing valve having two water inlets and one water outlet;

a second cooling water conduit for connecting one of the water inlets of said mixing valve and the outlet of said radiator;

a third conduit for connecting the water outlet of said block-side water jacket and the remaining one of the water inlets of said mixing valve;

a water pump connected between the water outlet of said mixing valve and said block-side water jacket for pumping water to said block-side water jacket;

a fourth conduit branched midway from said second conduit and connected with the water inlet of said head-side water jacket;

an auxiliary water pump disposed midway of said fourth conduit for pumping water to said head-side water jacket;

a fifth conduit branched midway from said third conduit and connected with said first conduit;

a one-way valve disposed midway of said fifth conduit for allowing the water to flow only from said third conduit to said first conduit;

a one-way valve disposed midway of said second conduit and between the branch point of said fourth conduit and said mixing valve for allowing the water to flow only from said branch point to said mixing valve; and a control unit for controlling the mixing ratio of said mixing valve, the displacement of said auxiliary water pump and the operation of said cooling fan.

2. A cooling system according to claim 1, further comprising:

a water temperature sensor for detecting the water temperature of said head-side water jacket;

a water temperature sensor for detecting the water temperature of said block-side water jacket; and an intake pressure sensor for detecting the pressure in the intake manifold of said internal combustion engine, wherein said control unit controls the mixing ratio of said mixing valve, the displacement of said auxiliary water pump and the operation of said cooling fan in accordance with detected signals of said water temperature sensors and said intake pressure sensor.

3. A cooling system according to claim 2, wherein the controls of said control unit are so performed that the water temperature of said head-side water jacket may be lower than that of said block-side water jacket.

4. A cooling system according to claim 1, further comprising an electric motor for driving said auxiliary water pump.

* * * * *